US005387186A

United States Patent [19]

Edland

[11] Patent Number: 5,387,186

[45] Date of Patent: Feb. 7, 1995

[54] SELF-STANDING TRACTION APPARATUS

[76] Inventor: Mitchell R. Edland, 6605 Rolling Vista, Dallas, Tex. 75248

[21] Appl. No.: 136,154

[22] Filed: Oct. 15, 1993

[51] Int. Cl.[6] ..... A61H 1/02

[52] U.S. Cl. ..... 602/36; 606/241; 254/391

[58] Field of Search ..... 602/32, 35, 36; 606/241; 482/131, 143, 144, 902; 254/391

[56] References Cited

U.S. PATENT DOCUMENTS

| | | | |
|---|---|---|---|
| 3,561,434 | 2/1971 | Kilbey | 602/36 |
| 3,659,594 | 5/1972 | Schwab . | |
| 3,960,146 | 6/1976 | Albrecht | 602/36 |
| 4,079,916 | 3/1978 | Einhorn et al. | 254/191 |
| 4,269,179 | 5/1981 | Burton et al. | 607/36 |
| 4,362,151 | 12/1982 | Cottrell . | |
| 4,466,599 | 8/1984 | Singer | 254/391 |
| 4,531,514 | 7/1985 | McDonald et al. . | |
| 4,574,789 | 3/1986 | Forster | 606/241 |
| 4,942,647 | 7/1990 | Wallner | 24/170 |
| 5,123,131 | 6/1992 | Jandrakovic | 254/391 |

FOREIGN PATENT DOCUMENTS

| | | | |
|---|---|---|---|
| 243845 | 9/1962 | Australia | 254/391 |

*Primary Examiner*—Stephen R. Crow
*Assistant Examiner*—Jeanne M. Mollo
*Attorney, Agent, or Firm*—Beaman & Beaman

[57] ABSTRACT

Traction apparatus for treating vertebral problems comprising a tripod type self-standing support having a block and tackle unit suspended from the tripod apex. The lower block includes a T-bar upon which triangular cushions are supported for location under the knees of a supine patient, and a torso encircling belt includes a strap passing through the patient's legs adjustably attachable to the lower block. The block and tackle tension member includes a tail passing from the upper block to the patient permitting the patient to raise and lower the leg supporting cushions to adjust the degree of back tension being achieved, and a lock mechanism mounted on the upper block permits automatic positioning of the degree of leg lift as determined by the tension produced in the block and tackle tail by the patient.

6 Claims, 2 Drawing Sheets

SELF-STANDING TRACTION APPARATUS

BACKGROUND OF THE INVENTION

1. Field of the Invention

The invention pertains to traction apparatus for producing tension within the lumbar spine, the apparatus being directly operable by the patient and utilizing automatic adjusting structure for producing and maintaining the desired extent of traction.

2. Description of the Related Art

It has long been recognized that vertebral disorders in the human back can be treated by placing the spine and vertebrae under tension, and a variety of traction devices have been proposed for treating the lumbar spine to overcome anatomical lordosis. Such devices include apparatus whereby the weight of the patient is supported by the shoulders and the natural body weight is used to produce traction upon the spine. Other devices include apparatus for lifting the legs or lower portion of the torso to place the spine under tension, and typical devices of this type are shown in U.S. Pat. Nos. 3,659,594; 4,362,151 and 4,531,514. Such devices of this type as presently available are expensive, difficult to operate by the patient alone, and difficulty is often encountered by the patient in using the apparatus and placing the body within the apparatus for treatment.

OBJECTS OF THE INVENTION

It is an object of the invention to provide traction apparatus which is economical to manufacture and purchase, which is simple and direct in operation, closely adjustable to provide the desired degree of traction, and easily operated by the patient without requiring outside assistance.

Another object of the invention is to provide a traction apparatus utilizing a tripod type self-standing support which may be readily folded into a concise configuration for storage and shipment.

Another object of the invention is to provide traction apparatus which is easy for the patient to use, not requiring complicated assembly or attachment procedures, and wherein the likelihood of the patient being harmed is substantially eliminated.

SUMMARY OF THE INVENTION

Traction apparatus in accord with the invention basically includes a self-supporting tripod device wherein the legs of the tripod are interconnected at their lower region by a pivoted linkage to prevent excessive separation, but insure proper separation for adequate support. At the tripod apex, the upper block of a block and tackle unit is suspended, and a T-bar is attached to the lower block having a pair of leg support cushions of a triangular transverse cross section mounted thereon.

The patient wears a belt about the lower torso, and the lower central region of the belt has a flexible webbed strap extending therefrom which passes between the patient's legs and attaches to an adjustable buckle mounted upon the lower block. The patient lies partially within the tripod with the legs over the cushions wherein the cushions are located below the knees and the block and tackle tension member tail is held by the patient, and tensioned to raise and lower the cushions-and the degree of traction produced within the spine.

The upper block includes an automatic releasable lock associated with the tension member tail whereby release of the tension in the tail by the patient will lock the tail against retraction into the block and tackle unit, and prevent extension of the block and tackle unit and lowering of the legs. Tensioning of the tail by the patient automatically releases the tail from the lock permitting the block and tackle to be retracted and the legs raised. Further, the patient may slowly lower the legs by extending the block and tackle unit by maintaining a pre-determined tension within the tail which prevents engagement of the tail with the lock. The automatic block and tackle tail lock minimizes the likelihood of the patient's legs and lower torso being accidentally "dropped", and a safe and reliable operation of the apparatus may be achieved by patients having no mechanical skills.

As the tripod columns and linkages are pivotally interconnected, the tripod may be folded to a concise storage or shipping configuration, the cushions may be readily removed from the T-bar, and the entire apparatus is of a relatively lightweight and low cost.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
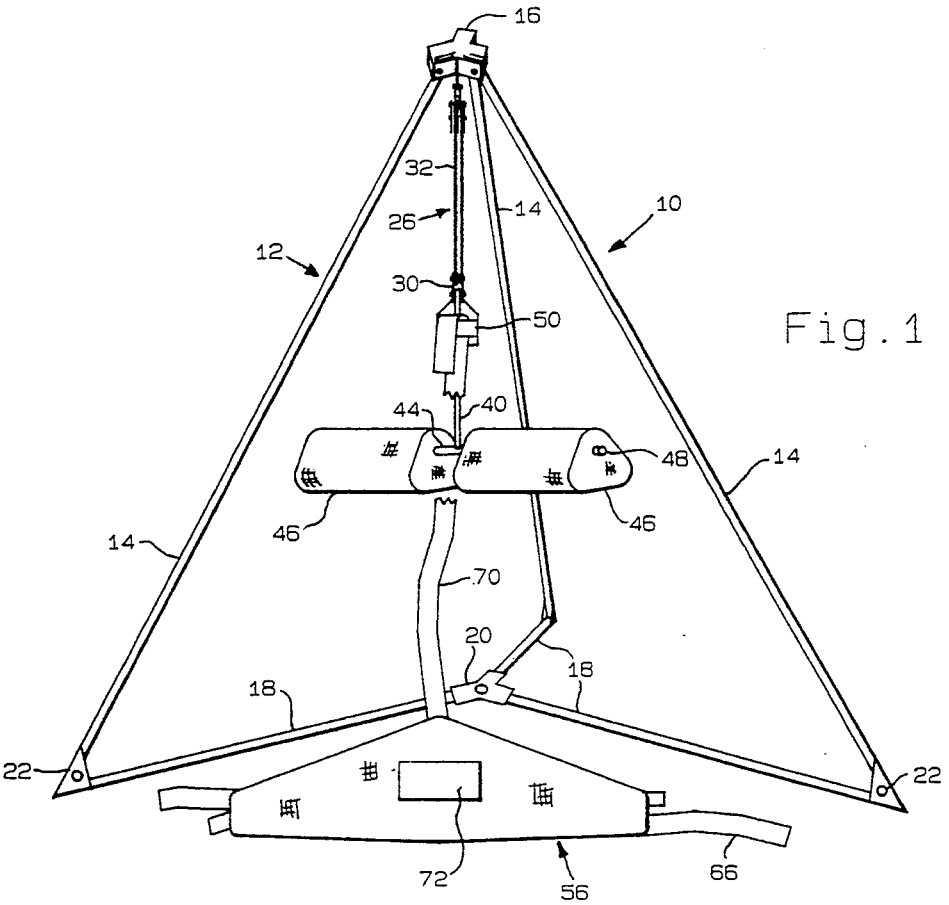
FIG. 1 is a perspective view of the self-standing traction apparatus in accord with the invention, no patient being located within the apparatus.
Figure 2:
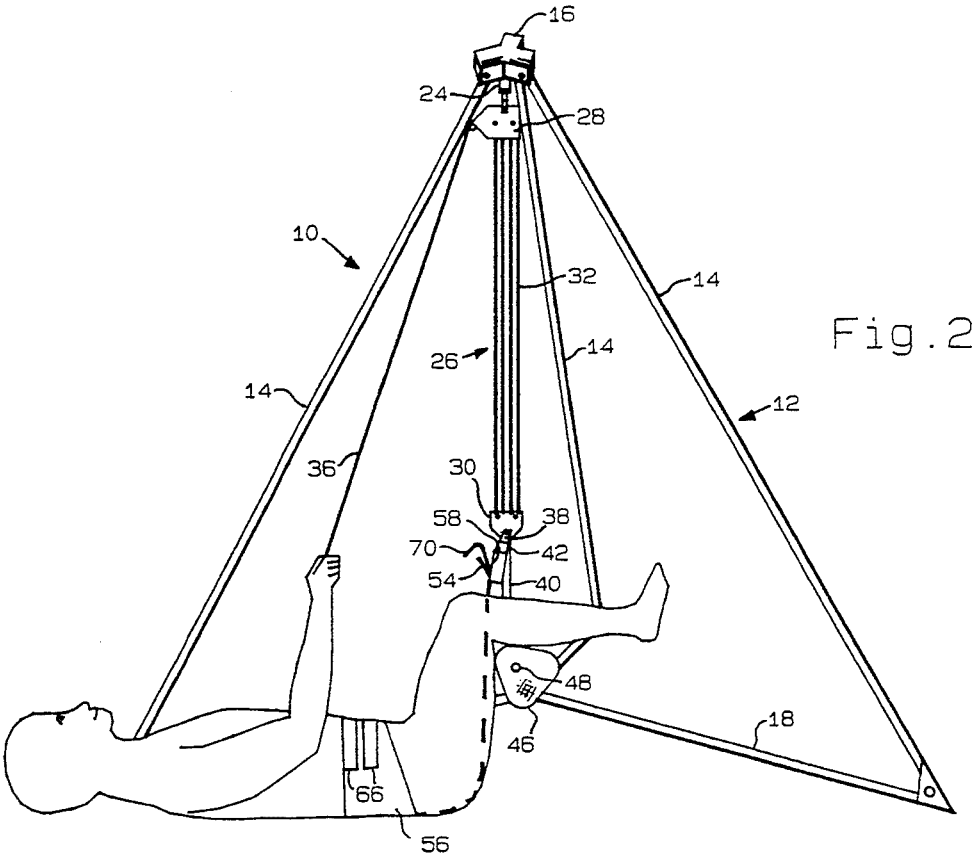
FIG. 2 is a perspective view of the traction apparatus of the invention illustrating a patient within the apparatus, and the patient being elevated to the initial traction position.
Figure 3:
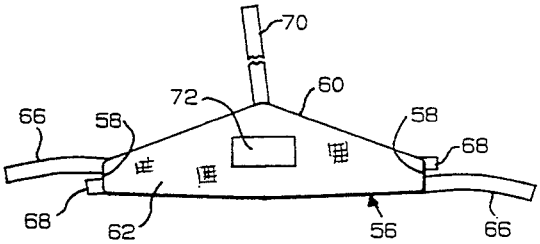
FIG. 3 is a detail view of the belt used with the traction apparatus of the invention illustrating the inner side.
Figure 4:
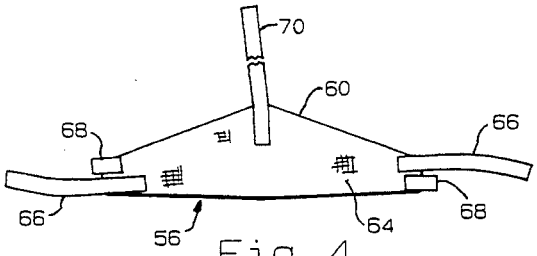
FIG. 4 is a detail view of the outer side of the belt.

With respect to FIGS. 1 and 2, the traction apparatus in accord with the invention is generally indicated at 10, and utilizes a self-standing tripod 12. The tripod consists of three columns 14 each pivotally connected to an apex bracket 16 wherein the lower ends of the columns may be pivoted inwardly or outwardly with respect to each other. The lower ends of the columns 14 are interconnected by links 18 pivotally joined together at a center bracket 20, and the columns are pivotally connected to the links at pivot points 22.

The aforedescribed tripod construction permits the tripod 12 to be folded to a concise arrangement wherein the columns 14 are substantially parallel to each other upon lifting of the center bracket 22 which pulls the lower ends of the columns toward each other. By holding the tripod above the floor by the bracket 16, the weight of the links 18 and center bracket 20 cause the lower ends of the column to extend outwardly establishing the proper spacing between the column lower ends to provide adequate support for the tripod. In use, the center bracket 20 will rest upon the floor, as will the lower ends of the columns, and the links 18 and center bracket 20 will be parallel to the floor surface and not interfere with use of the apparatus 10.

A block and tackle bracket 24 is suspended from the apex bracket 16, and the block and tackle unit 26 is attached to the bracket 24. The block and tackle unit 26 consists of an upper block 28, a lower block 30, and the blocks, and associated pulleys are interconnected by a tension member 32 which is in the form of a nylon cord of approximately one-quarter inch in thickness. The blocks 28 and 30 include the usual pulleys 34, and the tail of the tension member 32 is represented at 36 and extends from the upper block 28 about pulley 34' for access and tensioning to operate the block and tackle unit 26.

The lower block 30 includes a downwardly extending bracket 38 to which the T-bar 40 is attached. The T-bar 40 basically consists of a column having an upper end 42, and at the lower end of the T-bar the arms 44 extend in opposite directions therefrom to provide a support for the leg cushions 46.

The leg cushions 46, as will be appreciated from the drawings, are of a generally triangular transverse cross section for being comfortably placed under the knees of the patient, and the cushions 46 preferably include tubular sockets 48 for receiving the T-bar arms 44 whereby the cushions 46 are located upon opposite sides of the T-bar in a balanced relationship.

The block lower bracket 38 also includes a buckle 50 which consists of a cam operated by a cam lever 54. The buckle 50 is of the aircraft seat type whereby a strap located between the cam lever and an opposed support surface permits a web or belt to De held within the buckle, and the greater the tension on the web the greater the holding force produced. By rotating the cam lever 54 in the opposite direction the grip of the cam upon the web will be released, as is well known.

A belt 56 is adapted to be placed about the lower regions of the patient adjacent the buttocks, and the belt 56 includes lateral sides 58 and a bottom 60, and is defined by inner side 62 and an outer side 64. A pair of straps 66 are sewn to the outer surface 64 of the belt 54 and include small hook fasteners, and in a similar manner flexible straps 68 are sewn to the outer surface of the belt at the lateral sides including loop fasteners. The nook and loop material is of the well known type sold under the trademark VELCRO, and by overlapping straps 66 and 68 a pair of adjustable fasteners maintaining the belt 56 upon the patient are provided.

The belt 56 also includes a central webbed strap 70 extending from the central region of the bottom 60 for connection to the buckle 50 as later described. Also, a pocket 72 is sewn upon the belt inner side 62 to receive an ice packet, not shown, where, optionally, an ice pack may be received within the pocket 72 to maintain the spine in the region of the belt 56 at a reduced temperature for therapy purposes.

Figure 5:
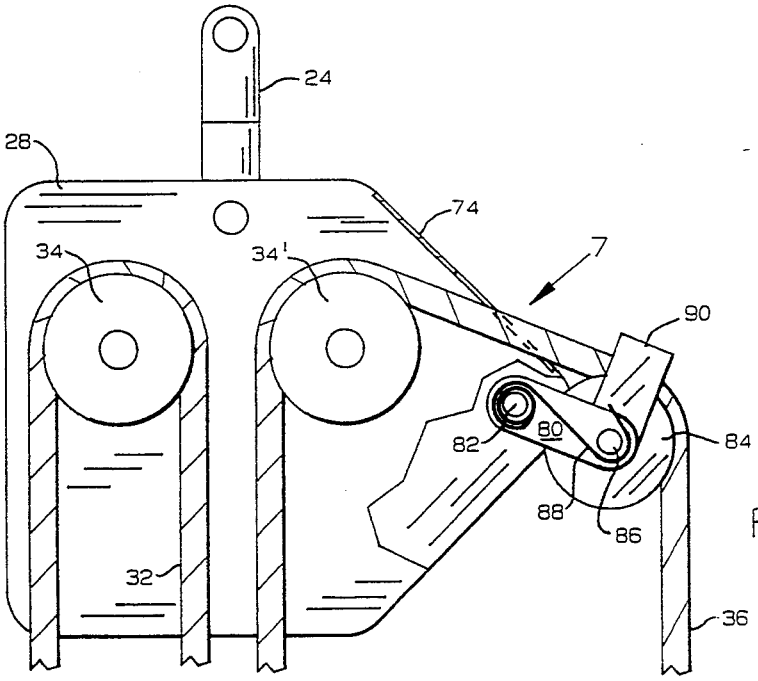
FIG. 5 is a side elevational view of the upper block of the block and tackle unit, the plate nearest the viewer being removed for purpose of illustration, and the tension member tail being shown located within the locking groove.

The upper block and tackle block 28 includes a web 74 extending between the sheet metal sides of the block, and a V-groove 76 is defined in the web 74 as will be appreciated from FIGS. 5–8. The V-groove 76 includes an open end 78 for receiving the block and tackle tail 36, and the dimensions of the V-groove 76 are such that the tail 36 will wedge within the V-groove and movement of the tail 36 in a direction to the left, FIG. 5, is prevented. As will be appreciated from FIG. 5, a pair of links 80 are pivotally attached to the sides of the upper block 28 by a pivot 82 adjacent the V-groove open end 78, and a roller 84 is rotatably mounted upon the outer end of the links 80 spaced from the pivot 82. The roller 84 is rotatably mounted upon the links 80 by the roller shaft 86. A torsion spring 88 concentrically related to the pivot 82 includes an extension engaging the pivot 86 which biases the links 80 in a counter clockwise direction, FIG. 5, and raises the roller 84 toward V-groove open end 78. A U-shaped handle 90 extends over the roller 84, and permits the links 80 and roller 84 to be pushed downwardly against the biasing force of the spring 88 wherein the roller 84 will be manually moved away from the V-groove open end 78.

In use, the patient will place the belt 56 about the lower torso so that the primary portion of the belt will be located across the lower back adjacent the buttocks. The straps 66 and 68 will be snugly interconnected so that the belt firmly embraces the patient's torso. The patient will then locate themselves with the lower portion of the torso within the confines of the tripod 12, and the legs will extend over the cushions 46 and the belt strap 70 will be located between the legs and inserted into the buckle 50. As will be appreciated from FIG. 2, the patient will now be located in a supine position on their back, the legs will be extending over the cushions 46 which engage the legs below the knees, and the end of the strap 70, after it is passed through the buckle 50, will be tensioned by the patient to partially raise the hips such that an approximate 90° angle will exist between the patient's torso and the thighs.

Thereupon, the patient will tension the block and tackle tension member tail 36 to raise the lower block 30, cushions 46 and belt 56 to produce the desired tension within the lower back. Of course, during this movement the shoulders of the patient will also aid in supporting the patient's weight.

Figure 6:
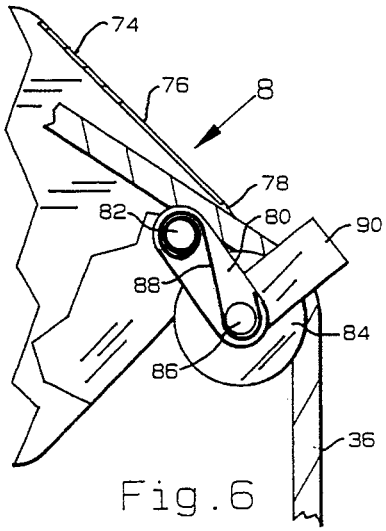
FIG. 6 is an enlarged detail, elevational view of the locking mechanism shown in the tail releasing position.
Figure 7:
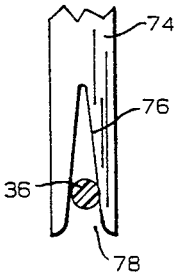
FIG. 7 is a schematic view illustrating the relationship of the locking groove and the tail during locking of the tail as taken in the direction 7 of FIG. 5.
Figure 8:
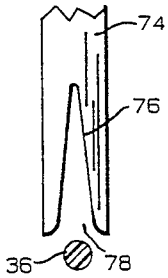
FIG. 8 is a view similar to that shown in FIG. 7 as taken in the direction 8 of FIG. 6, illustrating the tail released from the locking groove.

During retraction of the length of the block and tackle unit 26, and the raising of the block 30, cushions 46 and buckle 50, the tension within the tail 36 will pivot the links 80 in a clockwise direction, FIG. 6, in that the tail 36 passes over the roller 84 and the tension within the tail will pull the roller downwardly against the action of the spring 88. During such tensioning of the tail 36 to raise the patient's legs and lower region the roller 84, due to the tension in the tail, will permit the tail to directly pass over the pulley 34', and the block and tackle unit may be retracted in length as desired. However, as soon as tension within the tail 36 is released the spring 88 will pivot the roller 84 upwardly toward the V-groove open end 78, and upon the roller 84 moving upwardly into alignment with the V-groove open end 78 the portion of the tail 36 passing over the roller 84 will be received within the V-groove 76 and become wedged therein as the tail is retracted toward the groove. This wedging of the tail 36 within the V-groove 76 prevents extension of the block and tackle unit 26 and lowering of the lower block 30, and in this manners the traction apparatus will automatically maintain the desired elevation of the legs and lower torso of the patient to produce the desired traction.

If the patient desires a greater amount of traction the tail 36 will be tensioned sufficiently to pull the tail from the V-groove 76 pivoting the links 80 and roller 84 downwardly to clear the tail from the V-groove, and the lower block 30 may be raised as high as desired, and if the block and tackle unit 26 is raised to its maximum extent only a small portion of the patient's weight will be borne by the shoulders, and the patient will be in approximately full traction. As before, release of the tension within the tail 36 immediately permits the roller 84 to position the tail within the V-groove 76 locking the block and tackle unit from extension.

When the patient desires to lower the legs and lower torso, it is only necessary to grasp the tail 36 and tension the tail sufficiently to lower the roller 86 and pull the tail from the V-groove 76. While maintaining tension within the tail 36 to slowly lower the block and tackle lower block 30, and associated components, the roller 84 will be maintained in the position shown in FIG. 6, i.e. out of alignment with the V-groove 76, and the patient will have full control over the rate of block and tackle extension and lowering of the apparatus. The tail 36 will only enter the V-groove 76 upon the tension within the tail producing a lesser force on the link 80 in a downward direction than that provided in an upward direction by the spring 88.

During initial adjustment, for instance, when it is desired to initially extend the length of the block and tackle unit 26 to its maximum length, the roller 84, and links 80, may be manually lowered to prevent entering of the tail 36 into the V-groove 76 by manually depressing the links 80 by means of the handle 90. Merely by placing the thumb on the handle 90 and pushing downwardly the roller 84 may be sufficiently misaligned with the V-groove 76 to prevent locking of the tail within the V-groove.

For storage and shipping purposes, the T-bar 40 and cushions 46 may be disassembled from the lower block bracket 38, the cushions 46, by means of their sockets 48, may be removed from the T-bar arms 44, the belt strap 70 may be removed from the buckle 50, and the tripod columns 14 may be pivoted into a parallel relationship upon the raising of the center bracket 22 and pivoting of the links 18 to form an elongated concise configuration. As quickly disassembled, or assembled, the traction apparatus may be concisely stored or packaged for shipping.

It is appreciated that various modifications to the inventive concepts may be apparent to those skilled in the art without departing from the spirit and scope of the invention.

I claim:

1. Traction apparatus for the human body adapted to place the spine under tension comprising, in combination, a self-standing support having an upper region, an anchor defined upon said support upper region, an extendable and retractable block and tackle unit suspended from said anchor including an upper block attached to said anchor and a lower block suspended from said upper block by a tension member, a T-bar mounted on said lower block having a pair of arms transversely extending in opposite directions from a column having an upper end affixed to said lower block, a contoured cushioned leg support mounted on each arm, a belt having a central bottom, inner and outer surfaces, and lateral sides, fastening means defined on said belt lateral sides permitting said belt to lockingly embrace the lower torso of a patient, an elongated flexible strap affixed to said belt central bottom and extending therefrom, a buckle mounted on said lower block receiving said strap and adjustable along the length thereof, said tension member including an operating tail extending from said upper block a releasable lock mounted upon said upper block selectively locking said block and tackle unit tail against movement in a block and tackle unit extending direction upon release of a predetermined tension within said tail and releasing said tail upon said pre-determined tension occurring within said tail permitting bi-directional movement of said tail to selectively extend and retract said block and tackle unit and raise and lower said leg supports, said releasable lock mounted on said upper block including a V-shaped groove defined on said upper block selectively receiving said operating reception of said tail within said groove preventing movement of said tail and tension member in a block and tackle unit extension direction, and a spring biased tail deflector mounted on said upper block biasing said tail toward reception into said groove, the biasing force of said deflector being less than said pre-determined tension within said tail to release said tail from said releasable lock.

2. In a traction apparatus as in claim 1, said leg supports comprising elongated cushions having a generally triangular transverse cross section for conforming to the patient's legs under the knees.

3. In a traction apparatus as in claim 1, said belt strap comprising a woven web, and said buckle including a spring biased cam adapted to pinch said web upon tension occurring within said strap.

4. In a traction apparatus as in claim 1, said belt fastening means comprising a first flexible strap having loops defined thereon and a second flexible strap having hooks defined thereon engageable with said loops upon said first and second straps being overlapped.

5. In a traction unit as in claim 1, said deflector comprising a link pivotally supported upon said upper block about a pivot axis, a roller rotatably mounted upon said link and spaced from said link pivot axis, said tail engaging said roller, and a spring biasing said link in a direction to move said roller and engaging tail toward said V-groove and in alignment therewith.

6. In a traction unit as in claim 5, said spring comprising a torsion spring wound about said link pivot axis, and a handle defined on said link spaced from said pivot axis permitting direct manual pivoting of said link and roller to move said roller away from said V-groove and said tail in alignment therewith.

* * * * *